US008960179B2

(12) United States Patent
Yu et al.

(10) Patent No.: US 8,960,179 B2
(45) Date of Patent: Feb. 24, 2015

(54) AIR TREATMENT MODULE

(75) Inventors: Lei Yu, Shanghai (CN); Lee G. Tetu, Baldwinsville, NY (US); Brian D. Videto, Cortland, NY (US)

(73) Assignee: Carrier Corporation, Farmington, CT (US)

( * ) Notice: Subject to any disclaimer, the term of this patent is extended or adjusted under 35 U.S.C. 154(b) by 759 days.

(21) Appl. No.: 13/146,094

(22) PCT Filed: Feb. 17, 2010

(86) PCT No.: PCT/US2010/024425
§ 371 (c)(1),
(2), (4) Date: Jul. 25, 2011

(87) PCT Pub. No.: WO2010/099011
PCT Pub. Date: Sep. 2, 2010

(65) Prior Publication Data

US 2012/0037345 A1 Feb. 16, 2012

(51) Int. Cl.
*F24H 3/06* (2006.01)
*F24F 3/044* (2006.01)

(52) U.S. Cl.
CPC ..... *F24F 3/0442* (2013.01)
USPC ..... 126/99 R; 126/110 R; 126/112; 165/297

(58) Field of Classification Search
USPC ..... 126/99 R, 110 R, 112, 117; 165/297
See application file for complete search history.

(56) References Cited

U.S. PATENT DOCUMENTS

| | | | | | |
|---|---|---|---|---|---|
| 2,499,358 | A | * | 3/1950 | Cooper et al. | 165/7 |
| 3,073,296 | A | * | 1/1963 | Hollingsworth et al. | 126/110 R |
| 3,387,649 | A | * | 6/1968 | Mullins et al. | 165/59 |
| 4,250,866 | A | * | 2/1981 | Telkes | 126/116 A |
| 4,333,524 | A | | 6/1982 | Elkins et al. | |
| 4,730,461 | A | * | 3/1988 | Meckler | 62/159 |
| 4,739,746 | A | * | 4/1988 | Tomlinson | 126/110 R |
| 5,178,124 | A | * | 1/1993 | Lu et al. | 126/110 R |
| 5,201,024 | A | * | 4/1993 | Steffes | 392/344 |
| 5,271,376 | A | | 12/1993 | Lu et al. | |
| 5,562,089 | A | * | 10/1996 | Astle, Jr | 126/117 |
| 5,632,675 | A | * | 5/1997 | Kanninen et al. | 454/264 |
| 5,636,993 | A | * | 6/1997 | Badry | 454/263 |
| 6,564,794 | B1 | | 5/2003 | Zia et al. | |

(Continued)

FOREIGN PATENT DOCUMENTS

| | | |
|---|---|---|
| JP | 3156225 | 7/1991 |
| JP | 5196256 | 8/1993 |

(Continued)

OTHER PUBLICATIONS

International Preliminary Report on Patentability mailed Sep. 9, 2011.

(Continued)

*Primary Examiner* — Jorge Pereiro
(74) *Attorney, Agent, or Firm* — Cantor Colburn LLP

(57) ABSTRACT

An air treatment module includes an air plenum, a heat exchanger tube and a bypass duct. The bypass duct has an inlet opening in flow communication with the air plenum in juxtaposition with a selected region of the heat exchanger and an outlet opening in flow communication with a zone of lower air pressure. The presence of the bypass duct improves air flow over the heat exchanger tube in the selected region.

16 Claims, 4 Drawing Sheets

(56) References Cited

U.S. PATENT DOCUMENTS

| | | | | |
|---|---|---|---|---|
| 6,732,728 | B2 | 5/2004 | Hill et al. | |
| 6,793,015 | B1 | 9/2004 | Brown et al. | |
| 7,096,933 | B1 | 8/2006 | Zia et al. | |
| 7,104,312 | B2 | 9/2006 | Goodson et al. | |
| 2006/0086814 | A1* | 4/2006 | Helt et al. | 236/44 A |
| 2007/0202022 | A1 | 8/2007 | Shin et al. | |
| 2010/0070090 | A1* | 3/2010 | Mirpourian et al. | 700/278 |

FOREIGN PATENT DOCUMENTS

| | | |
|---|---|---|
| JP | 6281191 | 10/1994 |
| JP | 2005106303 | 4/2005 |

OTHER PUBLICATIONS

International Search Report and Written Opinion mailed Oct. 12, 2010.

* cited by examiner

AIR TREATMENT MODULE

CROSS REFERENCE TO RELATED APPLICATION

This application claims priority to U.S. Provisional Patent Application Ser. No. 61/154,974 entitled "Air Treatment Module," filed on Feb. 24, 2009. The content of this application is incorporated herein by reference in its entirety.

FIELD OF THE INVENTION

This invention relates generally to air treatment modules, such as, for example, heating units, ventilation units including a heat exchanger, or air conditioning (HVAC) units, and, more particularly, to improvement of heat exchanger performance in such air treatment modules. Air treatment units of the type including an air heating module are commonly used in connection with residential and commercial buildings to heat air for supply to a climate controlled space. Such air treatment units include, for example, products designed with both heating and cooling capability and also seasonal heating products.

BACKGROUND OF THE INVENTION

Commercial HVAC units including a heating function in addition to a cooling or cooling/dehumidifying function contained in a common cabinet are commonly used for heating, ventilating and air conditioning on commercial buildings. Typically, such packaged HVAC units are mounted on the rooftop of the building and connected into an air duct system associated with the building for passing air from within the building to be temperature conditioned to the HVAC unit and distributing temperature conditioned air throughout the building. In some applications, packaged HVAC units are ground mounted outside the building, rather than being mounted on the rooftop of the building.

Such year-around packaged HVAC units include an indoor section and an outdoor section housed within a common cabinet, but segregated by partitions and walls into separate compartments. The outdoor section includes one or more condensing units, each having a condenser heat exchanger coil and an associated fan, as well as other components such as a refrigerant compressor. The indoor section includes an air conditioning module, having an evaporator heat exchanger coil and an associated evaporator fan or fans, and an air heating module.

Commonly, the air heating module includes a furnace heat exchanger and an associated combustion system. In one type of air heating module, the furnace heat exchanger comprises a plurality of elongated hairpin-configured tubes defining an interior flow passage through hot flue gas generated by the associated combustion system is passed. The furnace heat exchanger is disposed in an air heating plenum through which indoor air is passed over the external surface of the heat exchanger tubes in heat exchange relationship with the hot flue gas passing through the furnace heat exchanger tubes.

The air heating plenum is typically disposed downstream with respect to air flow of the air discharge outlet of one or more indoor air fans. The heat exchanger tubes extend horizontally across the air heating plenum. The flue gas passing through each of the heat exchange tubes is hottest at the inlet end of each hairpin-configured tube and coolest at the outlet end of each hairpin-configured tube. In some designs, the air passes vertically downwardly over the heat exchange tubes to discharge downwardly through an opening in the floor of the air plenum. In other designs, the air passes vertically downwardly into the air heating plenum, but turns through 90-degrees within the plenum to exit horizontally through an opening in an end side of the air heating plenum. Thus, the air flow passes both across and along the hairpin-configured tubes of the furnace heat exchanger thereby increasing the time for which the air flow passes in heat exchange relationship with the flue gas relative to applications in which the air flows directly vertically downwardly over the heat exchange tubes.

The effectiveness of the heat exchange will be adversely impacted, that is heat exchange from the flue gas to the air will be reduced, in regions that may have relatively low air flow across or along the heat exchange tubes. The reduction of air flow across or along the heat exchange tubes may occur in certain regions due to the turning of the air flow as it passes through the air plenum. The reduced heat transfer may result in high temperature zones, i.e. hot spots, of the surface of the heat exchange tubes, which can also adversely impact reliability of the heat exchanger. Common steps taken in an attempt to provide a more uniform air flow across the heat exchanger and/or increase air flow in regions experiencing weak air flow, such as increasing the fan exhaust and air discharge opening areas, installing large fans, adding flow baffles within the heat exchanger, or adding fins on the heat exchanger tubes, add increased cost to the system and are not always effective in improving heat transfer to the air flow.

SUMMARY OF THE INVENTION

In an aspect of the invention, an air treatment module includes an air plenum, a heat exchanger tube and a bypass duct. The air plenum defines an air flow path and has an air inlet for receiving a flow of air to be treated and an air outlet through which a flow of treated air discharges from the air plenum. The heat exchanger tube is disposed in the air flow path within the air plenum for conveying a heat transfer fluid in heat exchange relationship with the flow of air to be treated. The bypass duct has an inlet opening in flow communication with the air plenum in juxtaposition with a selected region of the heat exchanger tube downstream with respect to air flow of the heat exchange tube and an outlet opening in flow communication with a zone of lower air pressure. In an embodiment, the outlet of the bypass duct opens in flow communication with an air supply duct for conveying the flow of air to be treated to the air plenum.

In an aspect of the invention, a packaged air conditioning unit is provided. The packaged air conditioner may be connected in flow communication with an indoor air return duct and with an indoor air supply duct, and an indoor air mover for drawing indoor air to be conditioned through the indoor air supply duct from a conditioned space, an air cooling module, and an air heating module. The air heating module includes a housing defining an air plenum establishing an air flow path and having an air inlet opening in flow communication to a discharge outlet of the indoor air mover and an air outlet opening in flow communication the indoor air supply duct, a heat exchanger module disposed in the air flow path within the air plenum for conveying a heat transfer fluid in heat exchange relationship with the flow of indoor air, and a bypass duct having an inlet opening in flow communication with the air plenum in juxtaposition with a selected region of the heat exchanger module downstream with respect to air flow of the heat exchange module and an outlet opening in flow communication with a zone of lower air pressure. For example, the bypass duct may open in flow communication with a region of the air plenum upstream with respect to air flow of the outlet opening from the air plenum and downstream with respect to air flow of the inlet to the bypass duct or with the indoor air return duct upstream with respect to air flow of an inlet to the indoor air mover.

In an embodiment of the packaged air conditioning unit, the indoor air mover to the air plenum is disposed upstream with respect to the heat exchanger module, the inlet of the bypass duct opens into the air plenum housing in juxtaposition to a selected region of the heat exchanger module, and the air outlet from the air plenum is disposed in an end wall of the air plenum housing. The air cooling module may comprise an air cooling evaporator disposed upstream with respect to indoor air flow of the indoor air mover. The air mover may comprise a centrifugal fan.

In an embodiment, the heat exchanger module includes a plurality of heat exchange tubes through which a flow of hot combustion flue gas is passed in heat exchange relationship with the flow of indoor air passing through the air plenum. The plurality of heat exchanges tubes may comprise a plurality of independent hairpin-shaped heat exchange tubes. The packaged air conditioning unit may include a plurality of flue gas generating burners, with a respective one burner of the plurality of flue gas generating burners operatively associated with a respective one of the plurality of heat exchange tubes.

BRIEF DESCRIPTION OF THE DRAWINGS

For a further understanding of the disclosure herein, reference will be made to the following detailed description which is to be read in connection with the accompanying drawing, where.

DETAILED DESCRIPTION OF THE INVENTION

An exemplary embodiment of the air treatment module of the invention will be described herein for purpose of illustrating with respect to a year-around packaged air conditioning unit, designated generally as 2. It is to be understood, however, that the air treatment module disclosed herein may be used in other applications, including, for example, but not limited to, seasonal heating products such as residential or commercial hot air furnaces.

Figure 1:
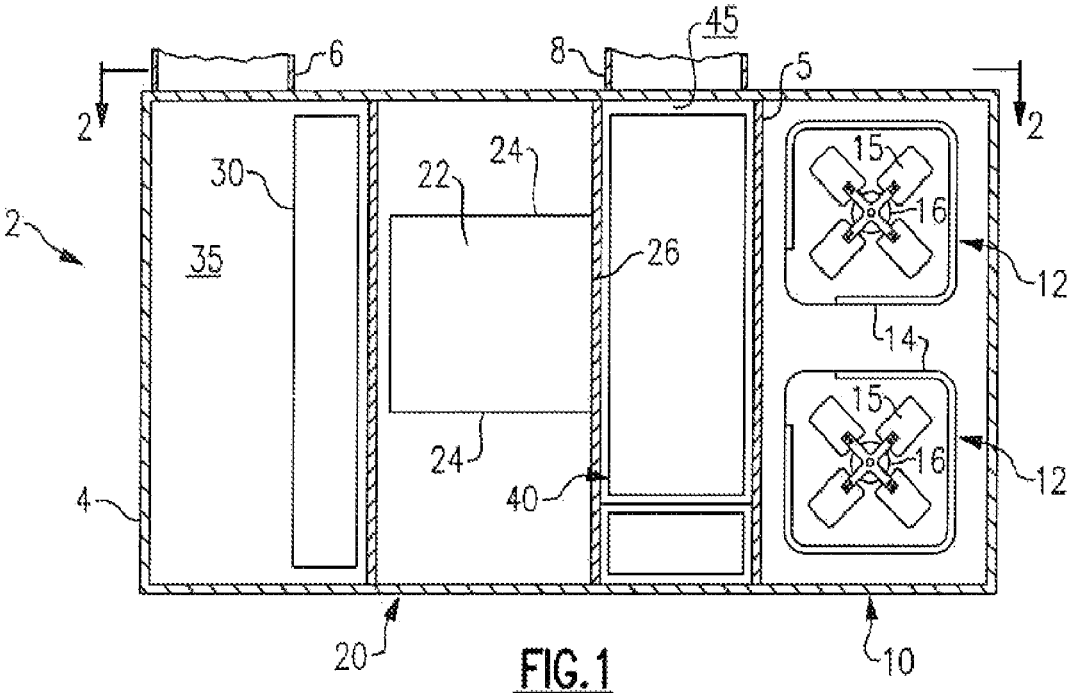
FIG. 1 is a plan view, partly in section, of a rooftop air conditioner.
Figure 2:
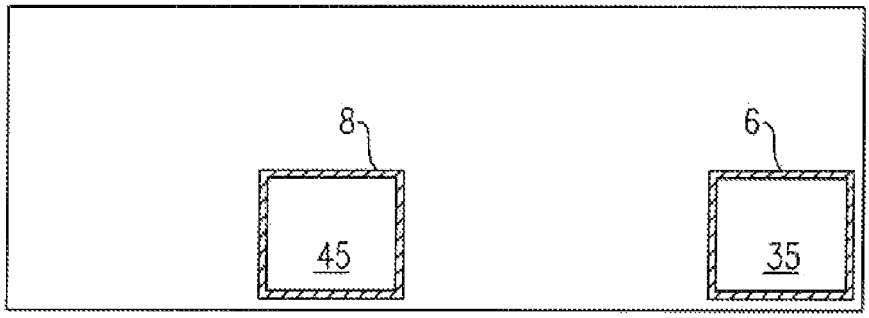
FIG. 2 is a side elevation view, partly in section, taken along line 2-2 of FIG. 1.
Figure 3:
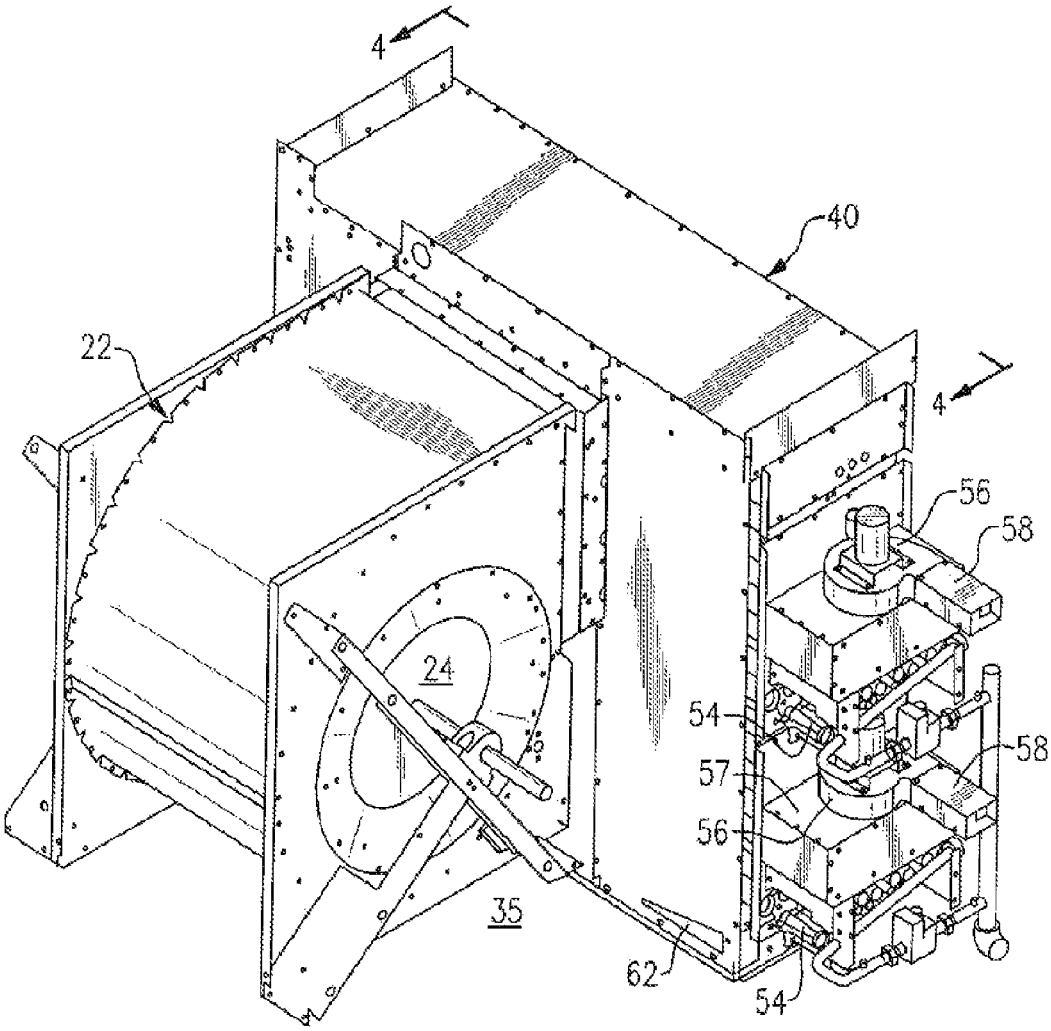
FIG. 3 is a perspective view of a portion the rooftop air conditioner shown in FIG. 1 showing the indoor air mover and the air heating module thereof.

Referring initially to FIGS. 1-2 of the drawing, in particular, there is depicted an exemplary embodiment of a packaged air conditioning unit of the type commonly installed on the rooftop of a building, such as for example a school, a hospital, an office building or other commercial establishment. However, in some installations, the packaged air conditioning unit 2 may be mounted on a support pad at ground level. The packaged air conditioning unit 2 includes a housing 4 partitioned by a wall 5 into an outdoor section 10 and an indoor section 20. The outdoor section 10 includes one or more condenser units 12 each of which includes a condenser coil 14, a condenser fan/motor assembly including a fan 15 and an associated drive motor 16, and a grille or cover (not shown). The condenser fan 15, driven by the condenser fan motor 16, conveys ambient outdoor air over the external surface of the condenser coil 14 surrounding the condenser fan/motor assembly to cool refrigerant circulating through the condenser coil 14 and discharges the air back into the ambient atmosphere. The outdoor section 10 may also include one or more compressors (not shown) for compressing refrigerant vapor and circulating the refrigerant through a refrigerant circuit (not shown) that connects the compressor(s), condenser coil(s) 14 and the evaporator heat exchanger of the air cooling module 30, the air cooling module being disposed within the indoor section 20.

The indoor section 20 includes an indoor air mover 22 and generally, the indoor section 20 includes both an air cooling module 30 and an air heating module 40. The air cooling module 30, which comprises an evaporative heat exchanger, is disposed upstream with respect to indoor air flow of the air intake 24 to the indoor air mover 22 and the heating module 40 is disposed downstream with respect to indoor air flow of the air discharge 26 from the indoor air mover 22. The evaporative heat exchanger may comprise a heat exchanger tube coil or tube bank wherein a cooling medium, such as refrigerant or chilled water, may be selectively passed through the tubes in heat exchange relationship with the air passing over the tubes of the tube coil when it is desired to cool the air.

When installed in association with a building for conditioning the air within a temperature controlled space within the building, the packaged air conditioning unit 2 may be connected in flow communication with an indoor air return duct 6 and with an indoor air supply duct 8. In addition if desired, louvers or vents may be provided in the housing that may be selectively opened to allow outdoor air to be drawn into the supply air plenum 45 to mix with the indoor air passing therethrough. The indoor section 20 includes a return air plenum 35 having an inlet in flow communication with the return air duct 6 and a supply air plenum 45 having an outlet in flow communication with the supply air duct 8. In the depicted embodiment, the indoor air mover 22 may be a centrifugal fan having a pair of side air intakes 24. The air intakes 24 of the indoor air mover 22 are in flow communication with the return air plenum 35 and the discharge 26 from the indoor air mover 22 opens in flow communication to the supply air plenum 45 which is located in the heating module 40. In operation, the indoor air mover 22 draws a flow of indoor air from a climate controlled space within the building through the return air duct 6 and the return air plenum 35 and passes that air flow through the supply air plenum 45 and the supply air duct 8 back into the climate controlled space. In traversing the return air plenum 35, the air flows through the cooling module 30. It is to be understood that the return air plenum 35 may have multiple return air inlets opening thereto and a plurality of associated air movers, and the supply air plenum 45 may have multiple supply air outlets.

Referring now also to FIGS. 3-6 of the drawing, the heating module 40 comprises the supply air plenum 45, one or more heat exchanger modules 50 and a bypass duct 60. The supply air plenum 45 defines an air flow path and has an air inlet for receiving a flow of air from the discharge of the indoor air mover 22 and an air outlet through which the flow of air discharges from the supply air plenum 45 into the supply air duct 8. The heat exchanger module(s) 50 are disposed in the air flow path within the supply air plenum 45 for conveying a heat transfer fluid in heat exchange relationship with the flow of air to be heated. The bypass duct has an air inlet 62 or a plurality of air inlets 62, opening in flow communication with the air plenum 45 in juxtaposition with a selected region of the heat exchanger module(s) 50 downstream with respect to air flow of the heat exchange tube module(s) and an outlet opening in flow communication with a zone of lower air pressure. In the embodiment depicted in FIGS. 3-6, the outlet 64 of the bypass duct 60 opens in flow communication with the return air plenum 35 for conveying the flow of air received into the bypass duct 60 back to the suction side of the indoor air mover 22.

In depicted embodiment, the air heating module 40 includes a pair of heat exchanger modules 50, with one module being disposed above the other module. The air passing from the discharge 26 of the indoor air mover 22 flows generally downwardly and across both of the heat exchanger modules 50 before exiting the supply air plenum 45 into the supply air duct 8. It is to be understood, however, that in some installations, the air heating module 40 may include a single heat exchanger module 50 or more than two heat exchanger tube modules.

In the depicted embodiment, each heat exchanger tube module 50 includes a plurality of individual heat exchanger tubes 52 through which a flow of hot combustion flue gas is passed in heat exchange relationship with the flow of indoor air passing through the air plenum. However, it is to be understood that the heat exchanger module 50 may instead comprise a liquid-to-air tubular heat exchanger or an electric resistance heating element or other type of heat exchanger wherein the air is heated by passing the air over a heated surface. Each of the heat exchange tubes 52 may comprise a hairpin shaped heat exchange tube. The plurality of heat exchanges tubes may comprise a plurality of independent hairpin-shaped heat exchange tubes. In the depicted embodiment, a plurality of flue gas generating burners 54, with a respective one burner 54 of the plurality of flue gas generating burners operatively associated with a respective one tube 52 of the plurality of heat exchange tubes. Each burner 54 combusts a fossil fuel, typically natural gas, in air to generate hot combustion products, termed flue gas, which pass into the inlet end of the respective heat exchanger tube 52 associated with the respective burner 54. The hot flue gas passes through the heat exchange tube 52 and discharges from the outlet of the heat exchange tube into an exhaust chamber 57 from which the flue gas is discharged via a fan 56 into and through a flue duct 58 which opens to the atmosphere. In passing through the heat exchange tubes 52, the hot flue gas is cooled as it transfers heat to the indoor air passing through the supply air plenum 45.

Figure 4:
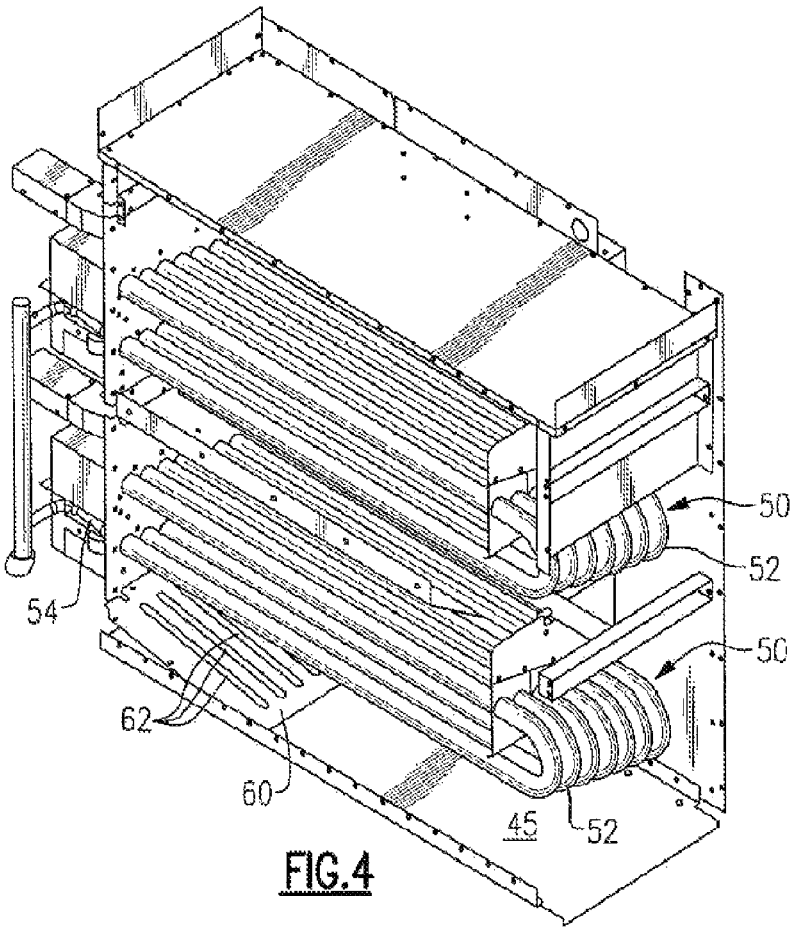
FIG. 4 is a perspective view of the air heating module shown in FIG. 3.
Figure 5:
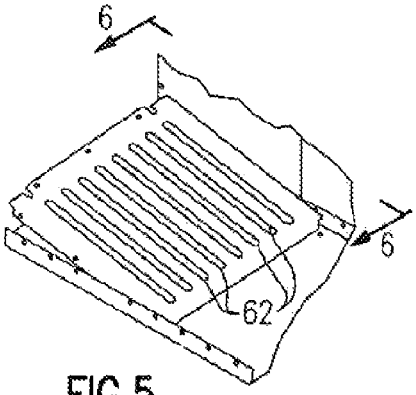
FIG. 5 is a perspective view of the bypass duct shown in FIG. 4.
Figure 6:
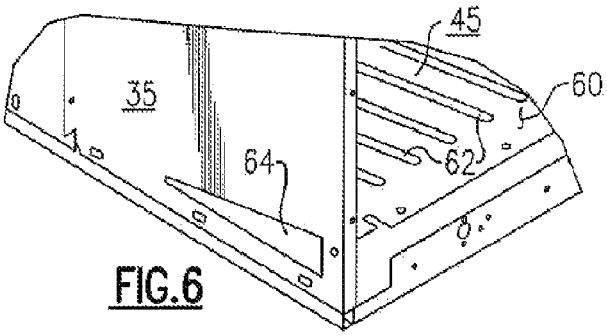
FIG. 6 is a perspective view of the bypass duct shown in FIG. 5 taken from the rear side of FIG. 5.

The bypass duct 60 is disposed in juxtaposition with the heat exchanger module 50, or the lower heat exchanger module of a plurality of heat exchanger modules, with a specific region of the heat exchanger module 50 wherein it is desired to increase the flow of indoor air over the heat exchanger tubes in that specific region. As the outlet 64 of the bypass duct 60 opens into a zone of lower air pressure, such as the return air plenum 35 in the depicted embodiment, an increased amount of the indoor air flow passing through the supply air plenum 45 will be drawn through the inlet openings 62 of the supply air duct, thereby increasing the flow of air over the heat exchange tubes 52 within this specific region of the heat exchanger module. For example, in the depicted embodiment, as best seen in FIG. 4, the bypass duct 60 is disposed beneath the lower heat exchanger module 50 at the end thereof whereat the hot flue gases generated by the burners 54 enter the respective heat exchanger tubes 52. This is typically the region in which the tube surface temperature is the hottest. Without the presence of the bypass duct 60, this region would typically also be the region of low air flow volume over the heat exchanger tubes.

Figure 7:
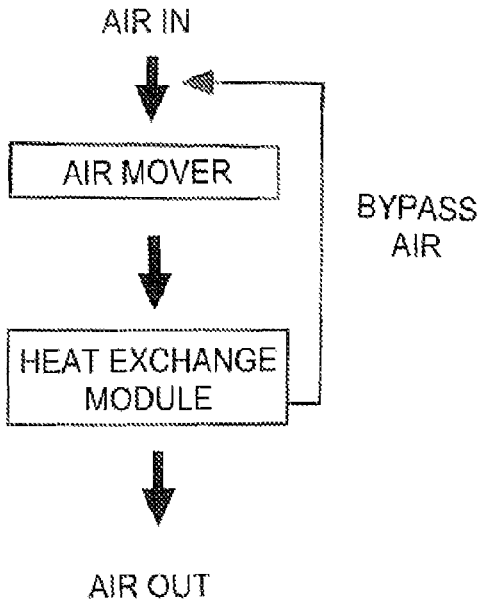
FIG. 7 is schematic diagram illustrating an embodiment of an air treatment module with a bypass circuit.

The bypass air may be reintroduced into the main air flow passing through the air treatment module at a zone of lower air pressure. In an embodiment, the bypass duct may open in flow communication with a zone of lower air pressure upstream with respect to air flow of the air mover as illustrated schematically in FIG. 7, whereby the bypass air is reintroduced into the main airflow upstream of the air mover. For example, in the depicted embodiment of the packaged air conditioning unit 2, the outlet 64 of the bypass duct 60 opens directly into the air mover plenum on the suction side of the indoor air mover 22. It is to be understood, however, that the bypass air may be introduced into other zones of lower air pressure further upstream of the air mover 22, such as back into the return air plenum 35 slightly downstream of the entrance to the supply air duct 8 or even directly into the supply air duct 8.

Figure 8:
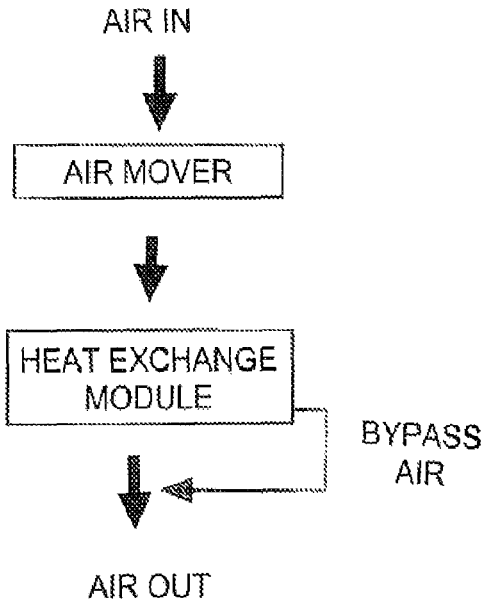
FIG. 8 is a schematic diagram illustrating another embodiment of an air treatment module with a bypass circuit.

In an embodiment, the bypass duct may open in flow communication with a zone of lower air pressure further downstream with respect to air flow of the inlet to the bypass duct as illustrated schematically in FIG. 8. For example, the bypass air may be ducted to another zone of lower air pressure such as back into the supply air plenum 45 at a location farther downstream with respect to air flow through the supply air plenum 45 of inlet 62 to the bypass duct 60, such as illustrated in FIG. 8 wherein the outlet of the bypass duct 60 opens into the supply air plenum 45 near the outlet to the supply air duct 8.

Applying the bypass air flow concept disclosed herein in connection with a selected region or regions of a heat exchanger module results in an increased air flow over the heat exchanger tubes or heating elements in the selected region or regions, thereby increasing heat transfer in the selected region or regions, and typically in a more uniform airflow across the heat exchanger module. Thus, heat exchanger module performance is increased and system reliability may be enhanced through the elimination of high temperature zones, i.e. hot spots, on the surface of the heat exchanger tubes or other heating elements. Because the bypass air flow is reintroduced into the main air flow through the air treatment module, the heat energy of the bypass air flow is recovered, thereby maintaining the thermal efficiency of the system. The bypass air concept disclosed herein is also less costly to implement than prior methods of increasing heat exchanger performance such as increasing fan capacity, The terminology used herein is for the purpose of description, not limitation. Specific structural and functional details disclosed herein are not to be interpreted as limiting, but merely as basis for teaching one skilled in the art to employ the present invention. While the present invention has been particularly shown and described with reference to the exemplary embodiments as illustrated in the drawing, it will be recognized by those skilled in the art that various modifications may be made without departing from the spirit and scope of the invention. Those skilled in the art will also recognize the equivalents that may be substituted for elements described with reference to the exemplary embodiments disclosed herein without departing from the scope of the present invention.

Therefore, it is intended that the present disclosure not be limited to the particular embodiment(s) disclosed as, but that the disclosure will include all embodiments falling within the scope of the appended claims.

We claim:

1. An air treatment module comprising:

an air treatment plenum defining an air flow path and having an air inlet for receiving a flow of air to be treated and an air outlet through which a flow of treated air discharges from the air treatment plenum;

an air heating heat exchanger disposed in the air flow path within the air treatment plenum for conveying a heat transfer fluid in heat exchange relationship with the flow of air to be treated; and a bypass duct having an inlet opening in flow communication with the air treatment plenum in juxtaposition with a selected region of the heat exchanger to increase airflow over the selected region of the heat exchanger and an outlet opening in flow communication with a zone of lower air pressure;

the bypass duct inlet opening being positioned downstream with respect to air flowing over the heat exchanger.

2. The air treatment module as recited in claim 1 wherein the outlet of the bypass duct opens in flow communication with an air supply duct for conveying the flow of air to be treated to the air treatment plenum.

3. The air treatment module as recited in claim 1 further comprising an air mover disposed upstream with respect to air flow of the air treatment plenum for supplying the flow of air to be treated to the air treatment plenum.

4. The air treatment module as recited in claim 3 wherein the outlet of the bypass duct opens in flow communication with a zone of lower air pressure upstream with respect to air flow of the air mover.

5. The air treatment module as recited in claim 1 wherein the outlet of the bypass duct opens in flow communication with a region of the air treatment plenum downstream with respect to air flow of the inlet to the bypass duct.

6. An air treatment unit adapted to be connected in flow communication with an indoor air return duct and with an indoor air supply duct, said air treatment module comprising:

an air mover for drawing indoor air to be conditioned through the indoor air return duct from a conditioned space;

an air cooling module; and an air heating module;

said air heating module including:

a housing defining an air treatment plenum establishing an air flow path and having an air inlet opening in flow communication to a discharge outlet of the air mover and an air outlet opening in flow communication the indoor air supply duct;

a heat exchanger module disposed in the air flow path within the air treatment plenum for conveying a heat transfer fluid in heat exchange relationship with the flow of indoor air; and a bypass duct having an inlet opening in flow communication with the air treatment plenum in juxtaposition with a selected region of the heat exchanger module to increase airflow over the selected region of the heat exchanger, the inlet opening positioned downstream with respect to air flowing over the heat exchanger module and an outlet opening in flow communication with a zone of lower air pressure.

7. The air treatment module as recited in claim 6 wherein the air mover is disposed upstream with respect to air flow of the heat exchanger module.

8. The air treatment module as recited in claim 7 wherein the air outlet from the air treatment plenum opens from the air treatment plenum housing beneath a selected region of the heat exchanger module.

9. The air treatment module as recited in claim 8 wherein the air outlet from the air treatment plenum is disposed in an end wall of the air plenum housing.

10. The air treatment module as recited in claim 6 wherein the outlet of the bypass duct opens in flow communication with a region of the air treatment plenum downstream with respect to air flow of inlet to the bypass duct.

11. The air treatment module as recited in claim 6 wherein the outlet of the bypass duct opens in flow communication with the indoor air return duct upstream with respect to air flow of an inlet to the indoor air mover.

12. The air treatment module as recited in claim 6 wherein the heat exchanger module comprises a plurality of heat exchange tubes through which a flow of hot combustion flue gas is passed in heat exchange relationship with the flow of indoor air passing through the air plenum.

13. The air treatment module as recited in claim 12 wherein the plurality of heat exchanges tubes comprises a plurality of independent hairpin-shaped heat exchange tubes.

14. The air treatment module as recited in claim 13 further comprising a plurality of flue gas generating burners, a respective one burner of the plurality of flue gas generating burners operatively associated with a respective one of the plurality of heat exchange tubes.

15. The air treatment module as recited in claim 6 wherein the air cooling module comprises an air cooling evaporator disposed upstream with respect to indoor air flow of the indoor air mover.

16. The air treatment module as recited in claim 6 wherein the air mover comprises a centrifugal fan.

* * * * *